US007621861B1

(12) United States Patent
Kalember et al.

(10) Patent No.: US 7,621,861 B1
(45) Date of Patent: Nov. 24, 2009

(54) ROTATIONAL EXERCISE APPARATUS

(76) Inventors: Robert S. Kalember, 19431 Business Center Dr., Northridge, CA (US) 91324; Michael W. Knight, 19431 Business Center Dr., Northridge, CA (US) 91324

( * ) Notice: Subject to any disclaimer, the term of this patent is extended or adjusted under 35 U.S.C. 154(b) by 0 days.

(21) Appl. No.: 11/787,248

(22) Filed: Apr. 16, 2007

(51) Int. Cl.
*A63B 22/14* (2006.01)

(52) U.S. Cl. ..... 482/147; 482/146; 482/34; 482/79

(58) Field of Classification Search ..... 482/79–80, 482/34, 146–147
See application file for complete search history.

(56) References Cited

U.S. PATENT DOCUMENTS 3,084,935 A 4/1963 Brown
3,100,639 A * 8/1963 Bonewitz ..... 482/147
3,384,369 A * 5/1968 Rumell ..... 482/147
3,441,271 A * 4/1969 Palacios ..... 482/146
3,704,885 A 12/1972 Raciunas
3,834,693 A * 9/1974 Poppenberger ..... 482/71
3,911,907 A * 10/1975 Smith, Jr. ..... 482/1
4,200,282 A * 4/1980 Agyagos ..... 482/147
4,285,516 A * 8/1981 Heatwole ..... 482/146
4,319,749 A * 3/1982 Agyagos ..... 482/147
4,390,180 A * 6/1983 Simjian ..... 482/131
4,429,869 A * 2/1984 Eckstein ..... 482/71
4,515,363 A * 5/1985 Schleffendorf ..... 482/100
4,538,807 A * 9/1985 Rice ..... 482/147
4,618,145 A 10/1986 Inada
4,629,181 A * 12/1986 Krive ..... 482/71
4,829,612 A * 5/1989 Adams ..... 5/81.1 RP
5,049,079 A * 9/1991 Furtado et al. ..... 434/253
5,533,948 A * 7/1996 Wilkinson ..... 482/27
5,599,262 A * 2/1997 Shih ..... 482/147
5,632,711 A * 5/1997 Hwang ..... 482/147
5,695,439 A * 12/1997 Lin ..... 482/146
5,813,958 A * 9/1998 Tomita ..... 482/146
5,830,107 A * 11/1998 Brigliadoro ..... 482/1
5,888,182 A * 3/1999 Shih ..... 482/147
6,176,817 B1 * 1/2001 Carey et al. ..... 482/146
6,475,120 B2 11/2002 Johnston
6,676,579 B1 * 1/2004 Lin ..... 482/146
6,685,601 B1 * 2/2004 Knapp ..... 482/104
6,740,011 B1 * 5/2004 Tsai et al. ..... 482/80
6,875,159 B2 * 4/2005 Chuang ..... 482/51
6,902,514 B2 * 6/2005 Chuang ..... 482/52
7,081,074 B1 * 7/2006 Rubin ..... 482/146
7,232,405 B2 * 6/2007 Ko ..... 482/146
7,314,436 B1 * 1/2008 Rubin ..... 482/92
7,438,675 B2 * 10/2008 Lin ..... 482/140
2002/0137610 A1 * 9/2002 Broudy et al. ..... 482/147
2004/0142802 A1 * 7/2004 Greenspan et al. ..... 482/146
2005/0043143 A1 * 2/2005 Chuang ..... 482/51
2005/0148450 A1 * 7/2005 Huang ..... 482/147

(Continued)

*Primary Examiner*—Lori Amerson
(74) *Attorney, Agent, or Firm*—Albert O. Cota

(57) ABSTRACT

A rotational exercise apparatus (10) for strengthen and toning the human body which consists of a collapsible stationary support frame (20) with horizontal gripping arms (22) and a base plate (52) attached in a horizontal position to the frame. A rotatable platform (54) is positioned on top of the base plate and freely rotates with a pair of swiveling foot plates (56) mounted on the platform upper surface. During use, a person places their foot on each foot plate (56) and exercises by rotating and counter rotating both the platform (54) and the foot plates (56) simultaneously while maintaining balance by holding onto the gripping arms (22).

17 Claims, 4 Drawing Sheets

U.S. PATENT DOCUMENTS

2005/0255977 A1* 11/2005 Slowinski ..... 482/147
2007/0027009 A1* 2/2007 Arnold ..... 482/146
2007/0270296 A1* 11/2007 Caldicott ..... 482/146
2008/0020915 A1* 1/2008 Pacheco et al. ..... 482/146
2008/0119337 A1* 5/2008 Wilkins et al. ..... 482/130

* cited by examiner

ROTATIONAL EXERCISE APPARATUS

TECHNICAL FIELD

The invention generally pertains to exercise apparatuses, and more specifically to stationary support frame that incorporates a rotating platform with swiveling foot plates for exercising a person's torso, legs, knees, ankles and feet.

BACKGROUND ART

Previously, many types of exercise devices have been developed to provide an effective means for supplying resistance and movement to a person's body for keeping fit by working out against a given resistance either self imposed, with an external force or rotation.

A search of the prior art did not disclose any patents that possess the novelty of the instant invention, however the following U.S. patents are considered related:

| Pat. No. | Inventor | Issue Date |
|---|---|---|
| 3,084,935 | Brown | Apr. 9, 1963 |
| 3,834,693 | Poppenberger | Sep. 10, 1974 |
| 3,704,885 | Raciunas | Dec. 5, 1972 |
| 4,618,145 | Inada | Oct. 21, 1986 |
| 6,475,120 B2 | Johnston | Nov. 5, 2002 |

Brown in U.S. Pat. No. 3,084,935 teaches a children's ride device having a circular base with opposed seats and a height adjustable center post much like a teeter-totter except unidirectional.

U.S. Pat. No. 3,834,693 issued to Poppenberger is for a ski instruction apparatus having a pair of movable platforms with ski boots on rotatable and vertical hinges.

Raciunas in U.S. Pat. No. 3,704,885 discloses a skiing training device having a base that slideably supports a platform for transverse movement. A pair of side foot rests glide on rods and an adjustable pin mounted on the base controls the platform travel.

Inada in U.S. Pat. No. 4,618,145 teaches a physical training apparatus including a support frame, a horizontal member pivotally and rotatably mounted to the support frame, and a vertical member mounted on the horizontal member. The vertical member is attached to a revolving disc which is slideable on the vertical member and rotates about a central axis.

U.S. Pat. No. 6,475,120 B2 issued to Johnston is for a revolving exercise apparatus having a frame with hand engagement handles, a seat support and power transfer means pivotally mounted to the frame. Optionally, back support and thigh engagement means are provided with resistance to further provide exercise.

DISCLOSURE OF THE INVENTION

There have been a myriad of exercise devices and apparatus developed for exercising different parts of the human body using some type of force in the form of weights and energy creating resistance. Movable belt devices create a stationary running platform and a host of other inventions have been directed to all parts of the body. Therefore, the primary object of the invention is to provide an apparatus that utilizes a rotating platform with swiveling foot plates that specifically exercises a person's torso, legs, knees, ankles and feet.

An important object of the invention is that the apparatus is inherently sturdy, robust and has sufficient weight to be stable during a rigorous work out. The invention's frame is fabricated of square and rectangular structural metallic tubing with welded joints which has more than sufficient structural integrity to remain stable during use.

Another object of the invention is the ability of the apparatus to collapse and fold into a smaller package for storage and transportation. This ability is consummated utilizing quick release pins at specific joints that, when removed, permit the outward facing member to fold contiguously against an adjoining member, ultimately creating a minimum volume package.

Still another object of the invention is the employment of resilient anti-slip material on the top surface of the foot plates, which protects a person from losing his or her footing during use.

Yet another object of the invention is the use of a foam cushion in the areas that are in contact and close proximity to a person's arms and upper body for protection from scrapes and bruising if the person inadvertently comes in contact with a hard surface.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 17:
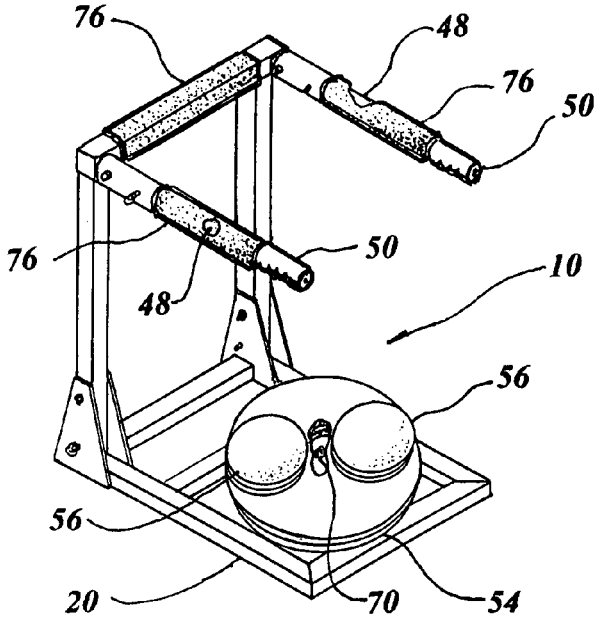
FIG. 17 is a partial isometric view of the rotational exercise apparatus shown in an embodiment with the gripping arms round and the handle grips and a cushion installed.

The best mode for carrying out the invention is presented in terms of a preferred embodiment. This preferred embodiment of the rotational exercise apparatus 10 is shown in FIGS. 1 through 16. An alternate embodiment changing only arms is illustrated in FIG. 17.

The preferred embodiment is comprised of a collapsible stationary support frame 20 having horizontal gripping arms 22 that are held onto for stability when a person is standing on the apparatus 10. The frame 20 consists of a frame base 24 that includes sides 26, a front 28 and a back 30 which is formed into a rectangular shape, preferably by welding. A pair of upward-extending base gussets 32 engage each of the sides 26 and the back 30, and a cross bar 34 is included in-between the sides 26 for stability.

The frame base 24 is preferably constructed using rectangular metallic tubes, with the base gussets 32 made from a flat plate with each including a pivot pin 36 and a quick release pin 38. The pivot pin 36 is preferably a bolt and a locknut, and the quick release pin 38 is preferably a ring grip self-locking pin, as illustrated in FIGS. 1-5.

Figure 1:
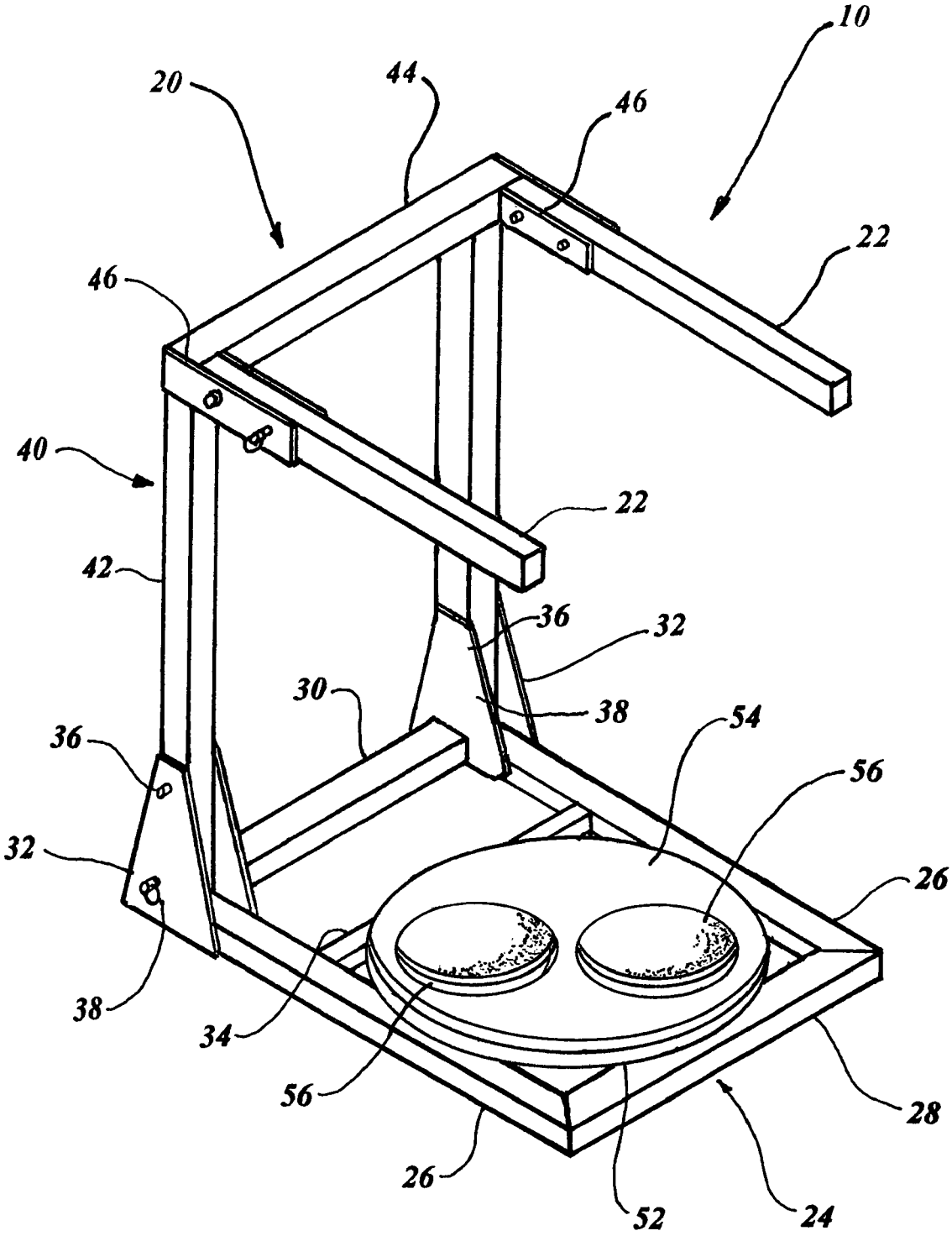
FIG. 1 is a partial isometric view of the rotational exercise apparatus in the preferred embodiment.
Figure 2:
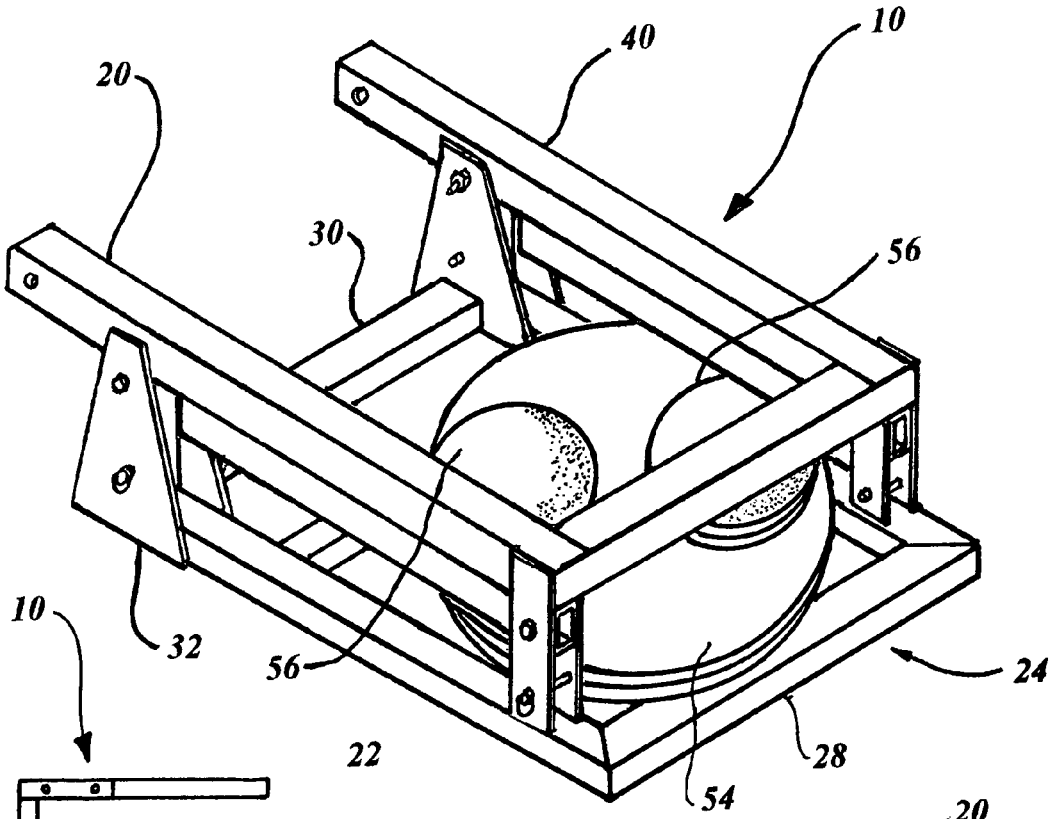
FIG. 2 is a partial isometric view of the rotational exercise apparatus in a collapsed position for storage and shipping.
Figure 3:
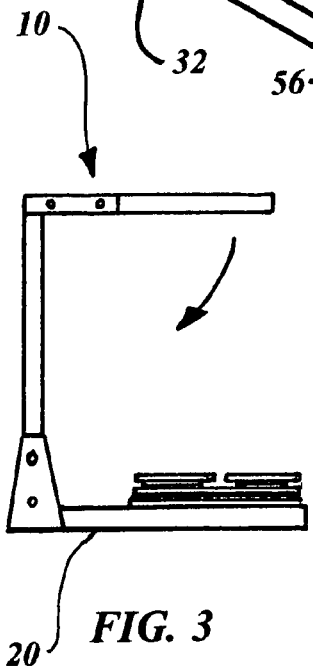
FIG. 3 is a left side view of the rotational exercise apparatus ready for collapsing with an arrow illustrating the first direction of the folding procedure.
Figure 5:
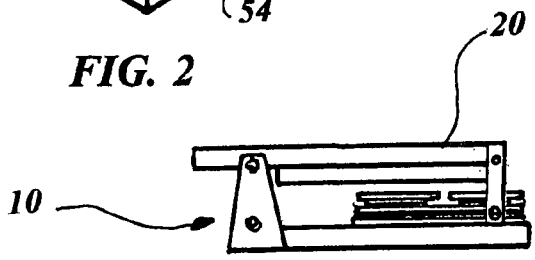
FIG. 5 is a left side view of the rotational exercise apparatus completely collapsed.
Figure 4:
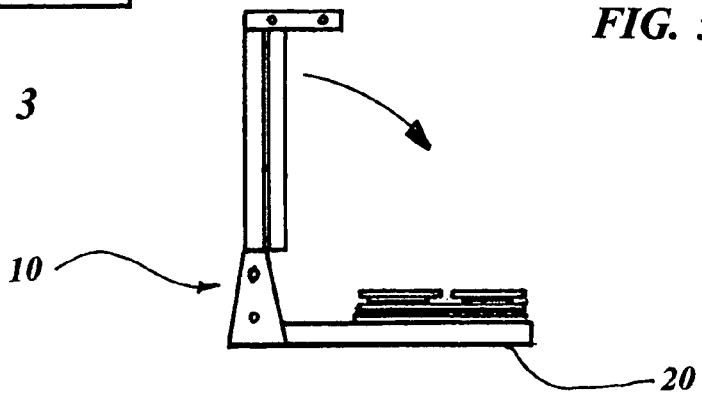
FIG. 4 is a left side view of the rotational exercise apparatus ready for collapsing with an arrow illustrating the second direction of the folding procedure.

A U-shaped upright 40 pivotally engages each pair of base gussets 32 and consists of two vertical legs 42 that are attached to a horizontal top member 44, as illustrated best in FIG. 1. Each U-shaped upright 40 includes at least one upright gusset 46 that is attached to each vertical leg 42 at right angles. The U-shaped upright 40 is made of a square tube construction and the upright gusset 46 is made using welded-on flat plates with each pair having a pivot pin 36 and a quick release pin 38 disposed therein that preferably consists of a bolt and a locknut, and a ring grip self-locking pin as described above.

The gripping arms 22 extend horizontally toward the frame base front 28 with the gripping arms pivotally attached to the upright gussets 46. Each gripping arm 22 preferably employs a rectangular tube construction, with each arm 22 pivotally attached to the upright gusset 46 with the pivot pins 36 and quick release pins 38. An alternate embodiment of the gripping arms 22 employs a round tube 48 construction, as illustrated in FIG. 17. In this embodiment a handle grip 50 may be used on the distal ends, as also shown in FIG. 17.

A stationary base plate 52 is rigidly attached onto the frame base 24 of the support frame 20 in a horizontal parallel position. Therefore the base plate 52 is higher than the floor level upon which the apparatus 10 is resting. The base plate 52, as shown in FIGS. 1 and 7, is in the form of a round flat disc that is constructed of metal, plywood, pressboard or injection molded thermoplastic.

Figure 7:
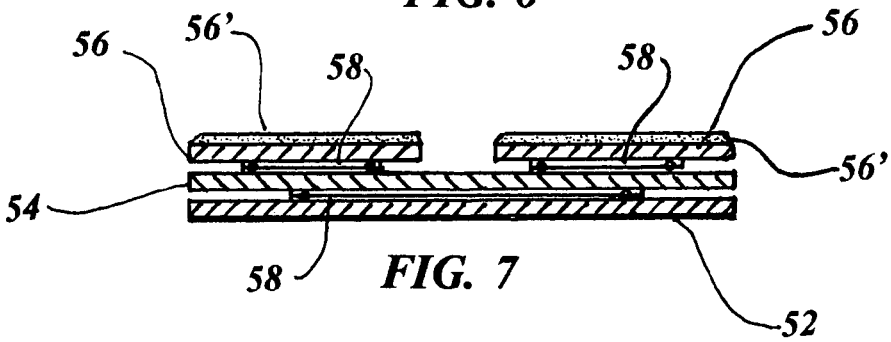
FIG. 7 is a cross-sectional view taken along lines 7-7 of FIG. 6.

A rotatable platform 54, as also shown in FIGS. 1 and 7, is juxtapositioned on the stationary base plate 52 in such a manner as to freely rotate above the base plate 52 when actuated under the control of the user. The rotatable platform 54 consists of a round flat disc that is constructed of metal, plywood, pressboard or injection molded thermoplastic.

A matched pair of swiveling foot plates 56 are configured to swivel on top of the rotatable platform 54, thereby permitting a person to place each of their feet on a separate foot plate 56. As shown in FIG. 1, the foot plates 56 each consist of a round flat disc that is constructed of metal, plywood, pressboard or injection molded thermoplastic. Additionally, each foot plate 52 incorporates a resilient anti-slip covering 56' on the top surface, such as closed cell vinyl, preferably with an irregular top surface or an indented design.

Figure 6:
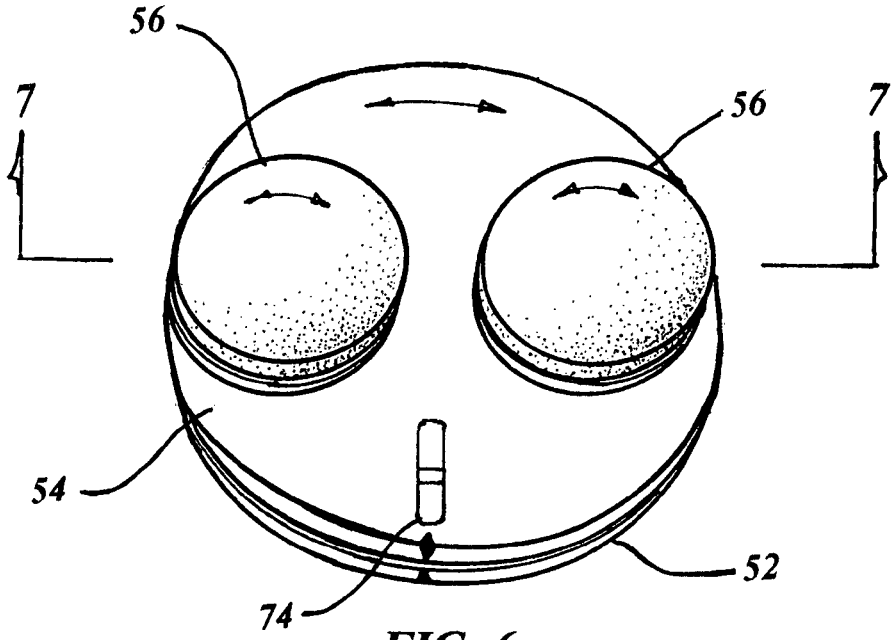
FIG. 6 is a partial isometric view of the rotatable platform in the preferred embodiment.
Figure 8:
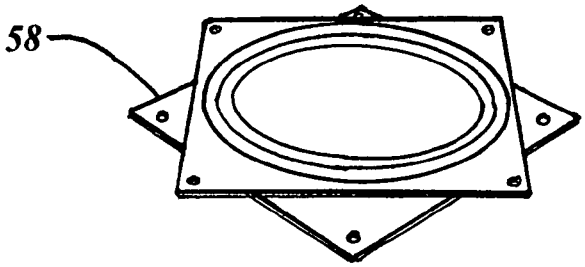
FIG. 8 is a partial isometric view of one of the ball bearing turntables completely removed from the invention for clarity.

The apparatus 10 is used for physically exercising the human body by rotating and counter rotating both the platform 54 and the foot plates 56 simultaneously while maintaining balance by holding onto the gripping arms 22. FIG. 6 illustrates the base plate 52 platform 54 and foot plates 56 in the preferred metal, plywood or pressboard embodiment, with FIG. 7 showing the details in cross-section. The platform 54 is permitted to rotate on the base plate 52 along with the foot plates 56 which are permitted to rotate on the platform 54, preferably in the form of a ball bearing turntable 58, as illustrated in FIG. 8.

Figure 13:
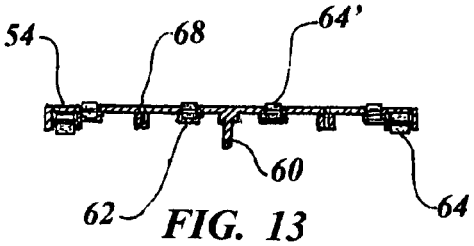
FIG. 13 is a cross-sectional view taken along lines 13-13 of FIG. 11.
Figure 14:
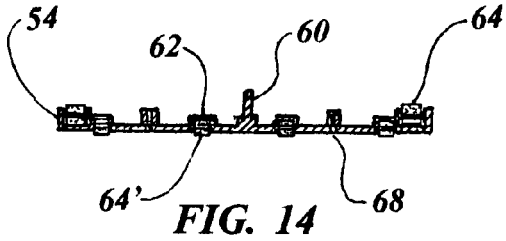
FIG. 14 is a cross-sectional view taken along lines 14-14 of FIG. 12.
Figure 15:
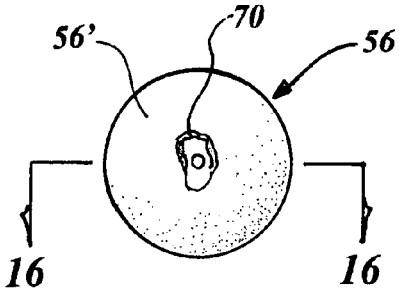
FIG. 15 is top elevation view of one of the rotatable foot plates completely removed from the invention for clarity.
Figure 16:
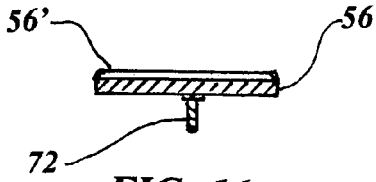
FIG. 16 is a cross-sectional view taken along lines 16-16 of FIG. 15.

An alternate embodiment for the rotation of the platform 54 and foot plates 56 consists of the rotatable platform 54 having the injection molded thermoplastic construction, with the round flat disc including a downward-depending centrally located platform spindle 60, as shown in FIGS. 13 and 14, and a number of integrally formed roller compartments 62. A tapered roller bearing 64 is disposed within each roller compartment 62 and is held in place with an axle 66 that is attached on distal ends into adjoining sides of the roller compartments 62.

The rotatable platform 54 includes two foot plate bores 68 for receiving the foot plates 56, and the stationary base plate 52 has a base plate bore 70, as illustrated in FIG. 17, to accept the rotatable platform spindle 60.

In this alternate embodiment the foot plates 56 are also injection molded thermoplastic and have a downward-depending centrally located foot plate spindle 72 therein. A number of roller compartments 62' are formed in the foot plates 56, with each foot plate having a tapered roller bearing 64' and axle 66' disposed within each roller compartment 62'.

Figure 9:
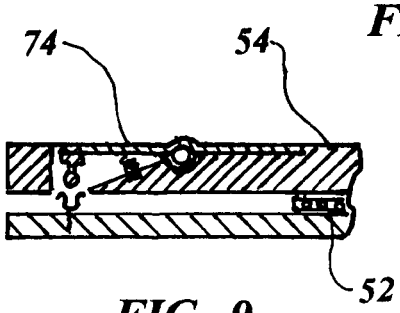
FIG. 9 is a cross-sectional view of the restraining lock in the unlocked position taken along an imaginary centerline.
Figure 10:
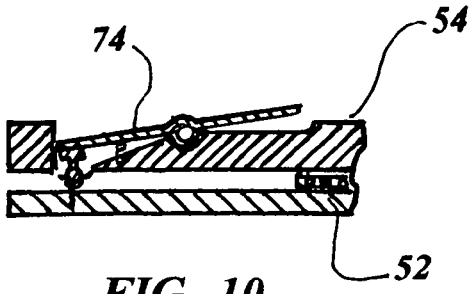
FIG. 10 is a cross-sectional view of the restraining lock holding the rotatable platform stationary in the locked position taken along an imaginary centerline.
Figure 11:
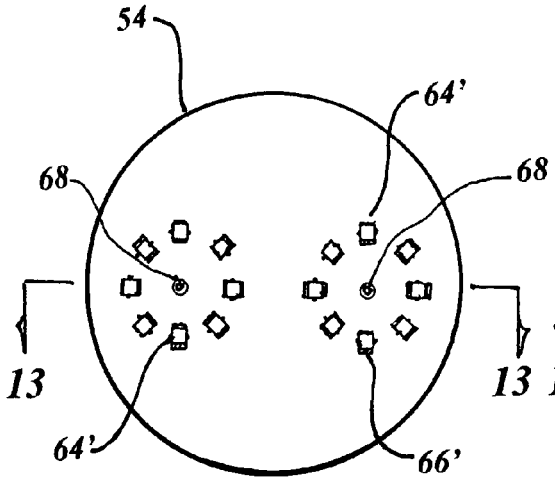
FIG. 11 is top elevation view of the rotatable platform in the injection molded embodiment completely removed from the invention for clarity.
Figure 12:
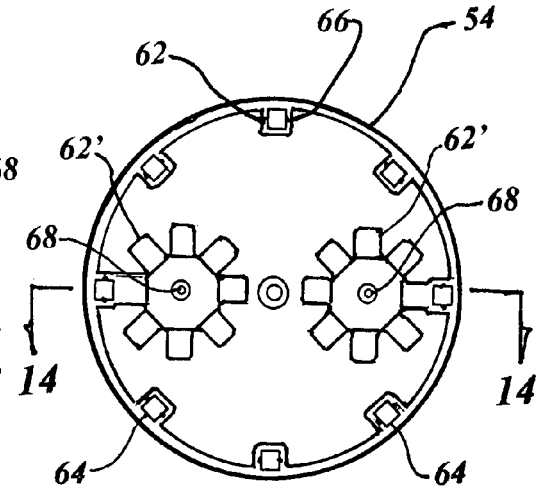
FIG. 12 is bottom view of the rotatable platform in the injection molded embodiment completely removed from the invention for clarity.

An optional rotation restraining lock 74 is in communication with the rotatable platform 54 and either the base plate 52 or possibly the frame base 24. The lock 74 may be any type or style that interferes and prevents the rotation of the platform 54 such as calipers, push-pull pins, magnets, cams, levers, sliding bolts etc. FIGS. 9 and 10 illustrate a representative lock 74 that is mounted in a recess in the platform 54 and that interfaces with the base plate 52.

A resilient closed cell foam cushion 76 may optionally be disposed upon the gripping arms 22 or any other appropriate portion of the frame 20 for protection when the person using the apparatus 10 inadvertently slips or falls. The cushion 76 is illustrated in FIG. 17 installed on the arms 22 and upright horizontal top member 44.

To use the rotational exercise apparatus 10, a person exercising grasps the gripping arms 22 with his or her hands, steps on the foot plates 56 and then releases the lock 74. The exercise consists of turning, twisting, rotating and counter rotating both the platform 54 and the foot plates 56 simultaneously while maintaining balance by holding onto the gripping arms 22. When finished exercising, the platform 56 may be locked in place.

The exercise apparatus 10 may be collapsed and folded flat for storage or transportation, as illustrated in FIGS. 2-5, with arrows pointing the sequence of folding.

While the invention has been described in detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the appended claims.

The invention claimed is:

1. A rotational exercise apparatus comprising:

a) a collapsible stationary support frame having horizontal gripping arms for gripping by a user's hand for stability when standing on the apparatus, wherein said support frame further comprises a frame base having sides, a front and a back forming a rectangle, with a pair of upward-extending base gussets engaging each of the sides and the back, a cross bar in between the sides for stability, a U-shaped upright having two vertical legs attached to a horizontal top member with the legs pivotally engaging each pair of base gussets, each U-shaped upright having at least one upright gusset on each vertical leg extending horizontally, and said gripping arms extending horizontally toward the frame base front with the gripping arms pivotally attached to said upright gussets, b) a stationary base plate rigidly attached to the stationary support frame in a horizontal parallel position with the base plate higher than floor level upon which said apparatus is resting, c) a rotatable platform juxtapositioned on said stationary base plate in such a manner as to freely revolve above the base plate, d) a matched pair of swiveling foot plates mounted onto said rotatable platform, thereby permitting a person to place a foot on each foot plate for exercising by rotating and counter rotating both the platform and the foot plates simultaneously while maintaining balance by holding onto the gripping arms, and e) said platform is permitted to rotate on said base plate and said foot plates are permitted to rotate on said platform.

2. The rotational exercise apparatus as recited in claim 1 wherein said frame base further comprises a rectangular tube construction, with said base gussets having a flat plate construction each with a pivot pin and a quick release pin.

3. A rotational exercise apparatus comprising:

a) a collapsible stationary support frame having horizontal gripping arms for gripping by a user's hand for stability when standing on the apparatus, wherein said support frame further comprises a frame base having sides, a front and a back forming a rectangle, with a pair of upward-extending base gussets engaging each of the sides and the back, a cross bar in between the sides for stability, a U-shaped upright having two vertical legs attached to a horizontal top member with the legs pivotally engaging each pair of base gussets, each U-shaped upright having at least one upright gusset on each vertical leg extending horizontally, and said gripping arms extending horizontally toward the frame base front with the gripping arms pivotally attached to said upright gussets, said frame base further comprises a rectangular tube construction, with said base gussets having a flat plate construction each with a pivot pin and a quick release pin, wherein said pivot pin further comprises a bolt and a locknut, wherein said quick release pin further comprises a ring grip self-locking pin, wherein said pivot pin and quick release pin permit said U-shaped upright to fold and engage said base frame to collapse for storage when the quick release pin is removed, b) a stationary base plate rigidly attached to the stationary support frame in a horizontal parallel position with the base plate higher than floor level upon which said apparatus is resting, c) a rotatable platform juxtapositioned on said stationary base plate in such a manner as to freely revolve above the base plate, d) a matched pair of swiveling foot plates mounted onto said rotatable platform, thereby permitting a person to place a foot on each foot plate for exercising by rotating and counter rotating both the platform and the foot plates simultaneously while maintaining balance by holding onto the gripping arms, and e) said platform is permitted to rotate on said base plate and said foot plates are permitted to rotate on said platform.

4. The rotational exercise apparatus as recited in claim 3 wherein said U-shaped upright further comprises a square tube construction, with said at least one upright gusset having a flat plate construction each with a pivot pin and a quick release pin.

5. The rotational exercise apparatus as recited in claim 3 wherein said pivot pin further comprises a bolt and a locknut, wherein said quick release pin further comprises a ring grip self-locking pin, wherein said pivot pin and quick release pin permit said gripping arm to fold and engage said U-shaped upright to collapse for storage when the quick release pin is removed.

6. The rotational exercise apparatus as recited in claim 3 wherein each gripping arm further comprises a rectangular tube construction with each arm pivotally attached to said at least one upright gusset with said pivot pin and said quick release pin.

7. The rotational exercise apparatus as recited in claim 3 wherein each gripping arm further comprises a round tube construction, with each arm pivotally attached to said at least one upright gusset with a pivot pin and a quick release pin.

8. The rotational exercise apparatus as recited in claim 7 wherein each gripping arm further having a handle grip on a distal end thereof.

9. A rotational exercise apparatus comprising:

a) a collapsible stationary support frame having horizontal gripping arms for gripping by a user's hand for stability when standing on the apparatus, b) a stationary base plate rigidly attached to the stationary support frame in a horizontal parallel position with the base plate higher than floor level upon which said apparatus is resting, c) a rotatable platform juxtapositioned on said stationary base plate in such a manner as to freely revolve above the base plate, d) a matched pair of swiveling foot plates mounted onto said rotatable platform, thereby permitting a person to place a foot on each foot plate for exercising by rotating and counter rotating both the platform and the foot plates simultaneously while maintaining balance by holding onto the gripping arms, and e) said platform is permitted to rotate on said base plate and said foot plates are permitted to rotate on said platform which further comprises:

said rotatable platform having an injection molded thermoplastic construction, said rotatable platform having a downward-depending centrally located foot plate spindle therein, said rotatable platform having a plurality of roller compartments formed integrally therein, a plurality of tapered roller bearings disposed within said roller compartments, each roller bearing having an axle therein attached on distal ends to said roller compartment, and said rotatable platform having two foot plate bores therein for receiving said foot plates.

10. The rotational exercise apparatus as recited in claim 9 wherein said stationary base plate further comprises a round flat disc that is constructed of a material selected from the group consisting of metal, plywood, pressboard and injection molded thermoplastic.

11. The rotational exercise apparatus as recited in claim 9 wherein said rotatable platform further comprises a round flat disc that is constructed of a material selected from the group consisting of metal, plywood, pressboard and injection molded thermoplastic.

12. The rotational exercise apparatus as recited in claim 9 wherein said swiveling foot plates further comprise a round flat disc that is constructed of a material selected from the group consisting of metal, plywood, pressboard and injection molded thermoplastic with a resilient anti-slip covering.

13. The rotational exercise apparatus as recited in claim 9 wherein said platform is permitted to rotate on said base plate and said foot plates are permitted to rotate on said platform further comprises a ball bearing turntable that is located between said base plate and said rotatable platform, and a ball bearing turntable that is located between each foot plate and said rotatable platform.

14. The rotational exercise apparatus as recited in claim 9 wherein said stationary base plate having a bore for receiving the rotatable platform spindle.

15. The rotational exercise apparatus as recited in claim 9 wherein said platform is permitted to rotate on said base plate and said foot plates are permitted to rotate on said platform, further comprises:

said foot plates having an injection molded thermoplastic construction, said foot plates having a downward-depending centrally located spindle therein, said foot plates having a plurality of roller compartments formed integrally therein, a plurality of tapered roller bearings disposed within said roller compartments, and each roller bearing having an axle therein attached on distal ends to said roller compartment.

16. The rotational exercise apparatus as recited in claim 9 further comprising a rotation restraining lock in communication with the platform and the base plate/frame.

17. The rotational exercise apparatus as recited in claim 9 further comprises a resilient closed cell foam cushion disposed upon said gripping arms and other portions of the frame for protection if a person using said apparatus inadvertently slips or falls.

* * * * *